US005690740A

United States Patent [19]

Smith

[11] Patent Number: 5,690,740

[45] Date of Patent: Nov. 25, 1997

[54] HIGH VOLUME LOW PRESSURE AIR ENTRAPMENT OF OVERSPRAY

[76] Inventor: William C. Smith, 7701 Whiterim Ter., Potomac, Md. 20854

[21] Appl. No.: 588,761

[22] Filed: Jan. 19, 1996

[51] Int. Cl.[6] ..... B05B 1/28

[52] U.S. Cl. ..... 118/300; 239/104; 239/296; 239/290; 118/315

[58] Field of Search ..... 118/300, 303, 118/600, 308, 63, 315; 239/290, 291, 292, 296, 298, 300, 525, 526, 527, 532, 104

[56] References Cited

U.S. PATENT DOCUMENTS

| | | | |
|---|---|---|---|
| 1,897,173 | 2/1933 | Long et al. . | |
| 2,101,922 | 12/1937 | Stoeslling | 91/45 |
| 2,438,471 | 3/1948 | Ball | 91/65 |
| 4,850,809 | 7/1989 | Smith | 417/76 |
| 4,857,367 | 8/1989 | Thorn et al. | 118/323 |
| 5,062,572 | 11/1991 | Reiter et al. | 239/899 |
| 5,393,345 | 2/1995 | Smith | 118/312 |

*Primary Examiner*—Donald E. Czaja
*Assistant Examiner*—Calvin Padgett
*Attorney, Agent, or Firm*—William S. Ramsey

[57] ABSTRACT

An apparatus is disclosed which uses a high volume low pressure air curtain in an "air chisel" to inhibit and reduce the bounceback and overspray of material sprayed on a work surface. The air chisel directs a lateral air curtain along each side of a plume of sprayed material parallel to the long axis of the plume and directed toward the contact of plume and work surface. An air chisel may be attached to a spray gun or may be mounted on a stand adjacent to the work surface. Any source of high volume low pressure air may serve to provide air to an air chisel.

20 Claims, 10 Drawing Sheets

HIGH VOLUME LOW PRESSURE AIR ENTRAPMENT OF OVERSPRAY

BACKGROUND OF THE INVENTION

1. Field of the Invention

This invention relates to atomization and application of fluids, such as paints, to a surface and to apparatus which minimizes loss of such fluids into the atmosphere.

2. Description of Related Art

Airless spraying equipment operate using pressures of 1800 to 2500 psig. Through the use of hydraulic pressure, fluid is conveyed to a spraying apparatus where it is forced through a small orifice. The high pressure by which it is propelled is responsible for "bounceback" whereby the fluid literally bounces back into the atmosphere of the work place. The fluid contaminates the environment, the worker, and the equipment.

The most prominent method of spraying a liquid or a powder is to use a high pressure gas, such as air, to entrain and carry the liquid or powder to a substrate or target. The high pressure gas explodes into the atmosphere creating a turbulence and finely pulverizes the solids. This turbulence dispenses the particles over a large area producing a deleterious fog or mist of toxic fumes and harmful solids. The danger to the worker, to the environment and to cost containment is obvious.

A conventional pneumatic spraying apparatus use high pressure, low volume compressor air at 50 to 60 psig and 4 or 5 cfm in concert with an air regulator to atomize fluids. Spraying with such an apparatus produces a wasteful cloud of fluid and air commonly referred to as "overspray". Overspray is created by the explosive expansion of the mixture of solids, liquids, and gas at the nozzle of the spray gun. Overspray contains an aerosol of fluid drops and solid particles including drops of 5 to 35 microns in diameter. Solvents in the fluid being sprayed are referred to as volatile organic compounds (VOC). VOC entrained in overspray rapidly evaporates. The VOC become part of the atmosphere and present a hazard to the environment and to the operator. Overspray also may be generated from the spraying of powders, in which case the overspray consists of an aerosol of solid particles.

A high volume low pressure (HVLP) spraying apparatus uses air at a low pressure and high volume. The term "HVLP" as used in this application means air delivered in a volume in cubic feet per minute (cfm) which exceeds the pressure of the air in pounds per square inch (psi). High pressure low volume (HPLV) as used in this application means air delivered in a volume in cfm which is less than the pressure of the air in psi. For example, air delivered at a volume of 22 cfm at pressure of 8 psi would be HVLP air. The relationship between the pressure and volume measurements, not the absolute numbers, defines HVLP. Air at 30 psi and 80 cfm would be classed as HVLP air, while air at 80 psi and 30 cfm would be classed as HPLV air. Typically EPA approved HVLP air is at a pressure of up to 10 psi and a volume of up to 30 cfm.

HVLP spraying reduces the incident of bounceback because the fluid sprayed contacts the target surface at a relatively low velocity. HVLP spraying reduces the incidence of overspray because the explosive expansive atomization of fluid which produces the aerosol is minimized when low pressure air is used.

In conventional usage, "overspray" is used as a genetic term which includes bounceback and overspray as described above, and is sometimes called errant spray. This generic usage will be used here.

U.S. Pat. No. 4,850,809, incorporated herein by reference, discloses an apparatus for HVLP spraying.

Transfer efficiency (T.E.) is a measurement used for comparing methods of atomization. T.E. is expressed as a percentage of the solid substances sprayed that become part of a substrate or arrive at the intended target. Conventional pneumatic spraying has a T.E. of 25%; airless spraying has a T.E. of 40%; and HVLP spraying has a T.E. of 75%.

The Environmental Protection Agency has expressed special concern about the hazards associated with airborne particles of a diameter of 10 microns or less ($PM_{10}$). That Agency has established regulations controlling $PM_{10}$ concentrations in outdoor applications, such as shipbuilding, bridges, towers, and architectural coatings. The production of $PM_{10}$ is virtually uncontrollable when conventional spraying or airless methods are used.

The production of VOC is often regulated in terms of tons VOC/day emitted per site. A typical spray booth is ventilated by a flow of air at 150 $ft^3$/minute per $ft^2$ surface being painted. The contaminated air is then treated to remove the VOC and $PM_{10}$, often by incineration, a very expensive process.

Two trends have emerged from efforts to protect the environment from solvents and aerosols resulting from overspray. In order to prevent bounceback spraying pressures are limited to 10 psig in most locations. In order to reduce solvent entry into the atmosphere, fluid formulations containing as much as 80% solids are often used.

The present invention uses directed HVLP air emitted from an elongated nozzle, termed an "air chisel", to entrap overspray onto the target surface and prevent the entry of overspray into the environment.

U.S. Pat. No. 2,438,471 discloses a curtain of air introduced around the spray nozzle which traps the rebounding portions of the coating mixture and forces it against the surface being coated. The air curtain is emitted through a series of holes in an annular air chamber extending entirely around the spray nozzle.

U.S. Pat. No. 1,897,173 discloses a cap like spray nozzle in which a central stream of liquid is surrounded by an annular air port. The liquid stream is modified by two opposed supplemental air ports which shape the emitted spray into a fairly sharply defined ellipsoid cross-section. The streams of air from the supplemental air ports form a tubular air sheath surrounding the liquid stream which forms the liquid stream into a fan-shaped spray.

The above two patents disclose apparatuses which use a curtain of air pressure. Each invention was made before the development of the use of HVLP air in spraying, when only HPLV air was in use. Although the air pressure and volume ratios are not disclosed in the above two patents, one may reasonably conclude that each used air at HPLV.

U.S. Pat. No. 2,101,922 discloses an apparatus for spraying melted paraffin onto porous surfaces. The stream of paraffin is surrounded by a sheath of heated air. One venturi arrangement is used to atomize and propel the paraffin in a stream of air while a second concentric venturi is used to provide the sheath of heated, low-pressure air.

U.S. Pat. No. 5,062,572 discloses an agricultural liquid sprayer having a wind shield to prevent disruption of the spray pattern by employing the wind to the advantage of the sprayer. The wind shield is in the shape of a horn which captures a side wind and directs it in the direction of the spray pattern.

U.S. Pat. No. 5,393,345, incorporated herein by reference, discloses an apparatus for having a jet venturi induction pump and respray nozzle mounted near the front of a sprayer. Overspray is captured by the induction ports of the induction pump and redeposited on the work surface.

SUMMARY OF THE INVENTION

This invention uses an oriented air curtain to contain and trap overspray and prevent the entry of overspray into the atmosphere. The air curtain is generated from HVLP air by a nozzle unit comprised of an elongated nozzle, a bore, and a conduit for LPHV air. The nozzle unit and oriented air curtain taken together are termed an "air chisel".

The plume, or profile of the area of impact of the sprayed material with the work surface, is typically in the shape of an elongated ellipse, with a long axis along the longest dimension of the plume, and a short axis along the shortest dimension of the ellipse. The air curtain formed by the elongated nozzle is also in the shape of an elongated ellipse, having a long and a short axis. In this invention the long axis of the plume is approximately parallel to the long axis of the air curtain. The air curtain is emitted from the nozzle or nozzles mounted at the side of the spray nozzle and directed inwardly toward the plume.

The air chisel gently blows the overspray back against the work surface, thereby reducing escape of overspray into the atmosphere and at the same time producing a better coating on the sprayed work surface.

The objective of this invention is to reduce the emission of overspray into the atmosphere associated with spraying of atomizable liquid or powder.

Another objective is to provide a sprayed work surface having superior coating.

Another objective is to economize on the use of atomizable liquid or powder by maximizing the coating obtained from a given quantity of material sprayed.

Another objective is to increase the production rate of sprayed objects.

Another objective is to protect the health of operatives by inhibiting the generation of aerosols of material sprayed.

Another objective is to reduce the quantity of airflow required to protect the operatives from overspray generated at a work surface.

Another objective is to reduce the requirement for respirator use by operatives.

Another objective is to provide a spray gun having a shield which directs the air chisel toward the work surface and which increases the effectiveness of the air chisel in suppressing overspray.

Another objective is to provide a spray apparatus which functions in an efficient, effective manner with minimal environmental impact.

DESCRIPTION OF THE PREFERRED EMBODIMENTS

Figure 1:
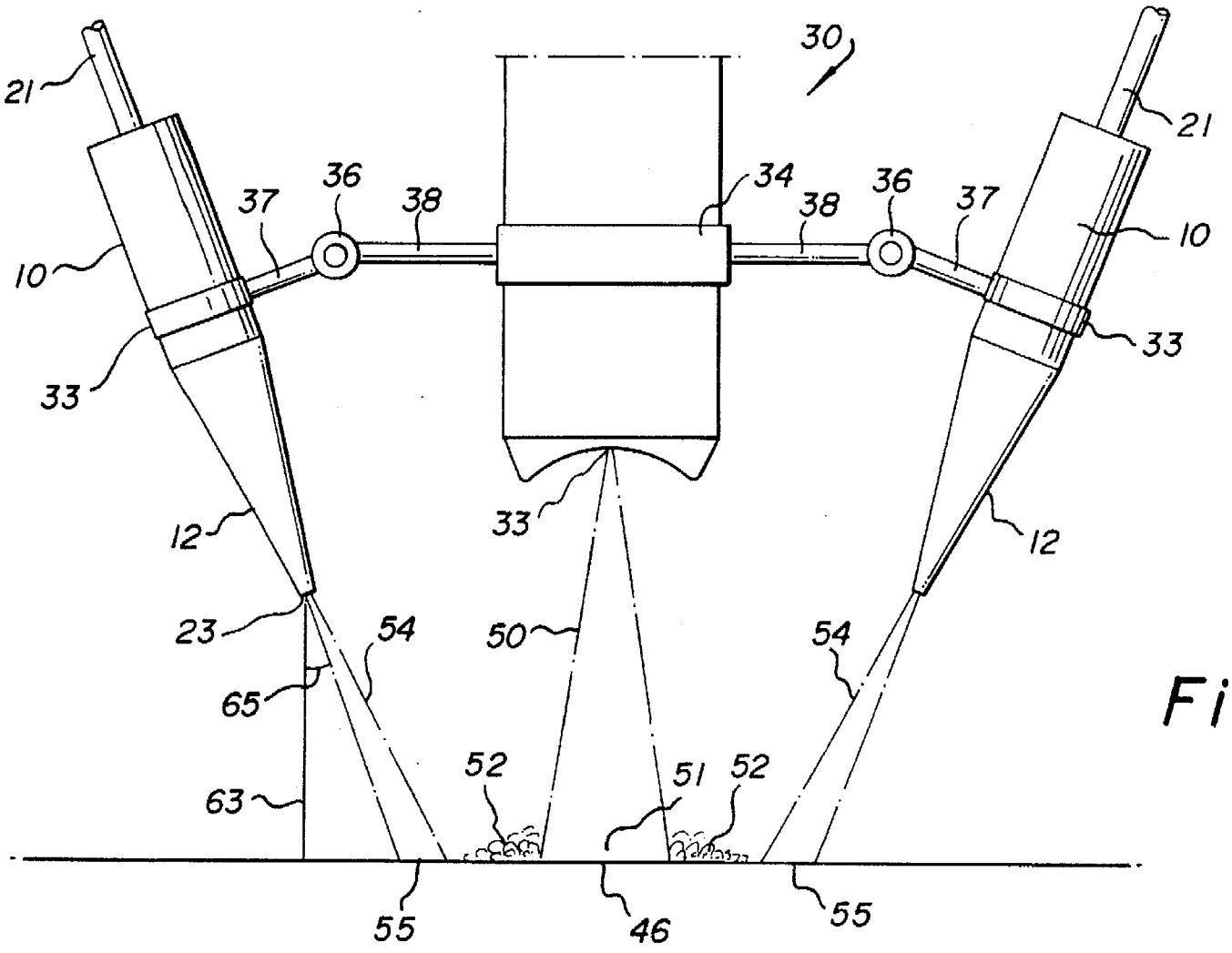
FIG. 1 is a diagram showing the suppression of overspray by two air chisels.

FIG. 1 is a diagrammatic side view of a spray gun with two attached nozzle units. A spray gun 30 sprays atomizable liquid or powder 50 from a spray nozzle 33 onto a work surface 46. The generation of a small amount of overspray 52 is shown.

The generation of overspray is suppressed by two air chisels 12. An air chisel consists of a nozzle unit 12 in combination with an oriented air curtain 54. The nozzle unit 13 emits HVLP air from an elongated nozzle 23 in an air curtain 55 which forms an ellipse-like shape or air plume 55 on contact with the work surface 46. The air plume is adjacent to the ellipse-like shaped spray plume 51, which is the shape of the contact of the sprayed liquid or powder and the surface of the work. The elongated air plume is parallel and adjacent to the spray plume.

Figure 2:
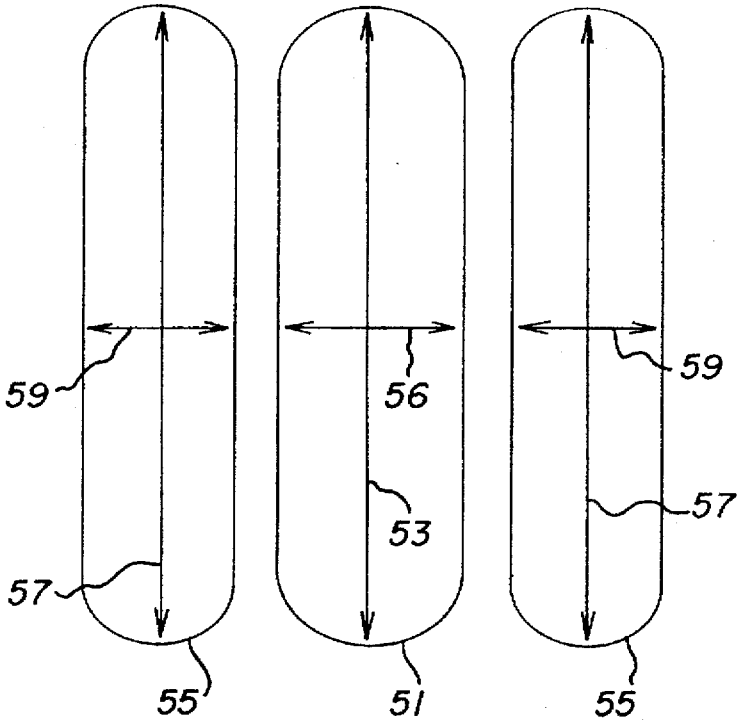
FIG. 2 is a diagram showing the spray plume and the air plumes of FIG. 1.

The relationship between the air curtains of the air chisels and the spray plume of the sprayed material is shown in FIG. 2. The sprayed plume 51 has a long axis 53 and a short axis 56. Each air plume 55 has a long axis 57 and a short axis 59. The long axis 57 of each air plume 55 is approximately parallel to the long axis 53 of the spray plume 51.

FIG. 1 shows the orientation of the air curtain 54 with respect to the work surface 46. A line 63 is drawn perpendicular to the work surface 46. The air curtain 54 is inclined to the line 63 at an angle 65 which is from 10° to about 80° to the line 63.

Each nozzle unit 12 consists of an elongated nozzle 23, a bore 10, and a conduit or hose 21 which provides HVLP air.

In FIG. 1, each nozzle unit 12 is attached to the spray gun 30 by a ring 34 which surrounds the barrel of the spray gun Two spray gun posts 38 are attached to the ring on opposite sides of the spray gun. An adjustable coupling 36 connects the spray gun posts 38 to the nozzle unit post 37. Each nozzle unit post 37 is connected to the respective bore 10 by a nozzle unit ring 39. The adjustable coupling 36 allows the orientation of the air curtain to be varied as desired.

The effect of the air chisels is to inhibit, contain, and retard the development of overspray 52. In this process, the loss of sprayed material to overspray and the generation of VOC is inhibited. In addition, the effect of the air curtains causes the sprayed material to form a smoother, finer finish on the work surface.

The orientation of the air curtains with respect to the work surface may be varied depending on the nature of the sprayed liquid or powder. A relatively light sprayed material of low viscosity liquid will use an orientation in which the air curtain is approximately parallel or at a relatively small inclination, 10°, to a line perpendicular to the work surface. The use of a relatively heavy or highly viscous sprayed material will require the orientation of the air curtain at a greater angle, up to 80° to the line perpendicular to the work surface.

Figure 3A:
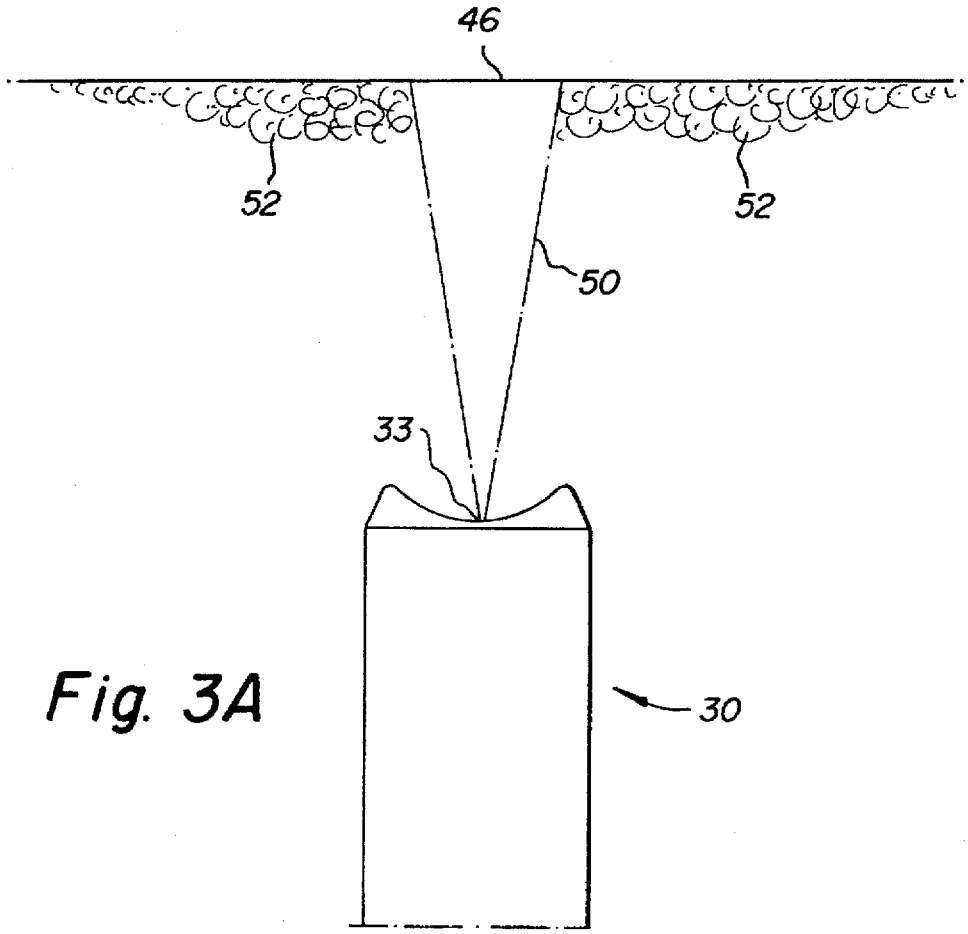
FIG. 3A is a diagram showing the generation of overspray by a spray gun spraying on a work surface.

FIG. 3A is a diagram showing a spray gun 30 which emits sprayed material 50 from a nozzle 33. The sprayed material 50 contacts the work surface 46 with the generation of overspray 52. This invention may be used with spray guns which use HVLP or HPLV or airless spraying systems. The maximum overspray is generated with HPLV spraying. A lesser amount of overspray is generated with HVLP spraying; and a minimum with airless spraying; but all systems generated overspray.

Figure 3B:
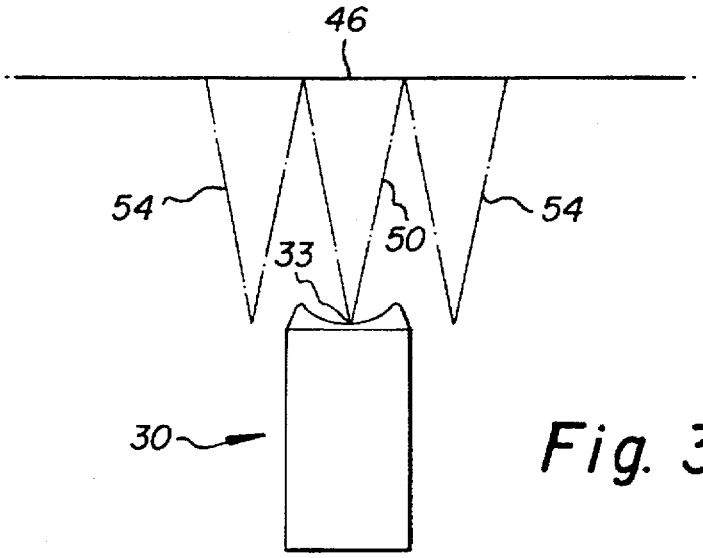
FIG. 3B is a diagram showing the suppression by air chisels of overspray generated by a spray gun spraying on a work surface.

FIG. 3B is a diagram showing the effect of air curtains 54 on the overspray 52 of FIG. 3A generated by spraying sprayed material 50 from the nozzle 33 of a spray gun 30 on a work surface 46. The overspray is eliminated. The sprayed material of the overspray is deposited on the work surface and is not emitted into the atmosphere.

Figure 4:
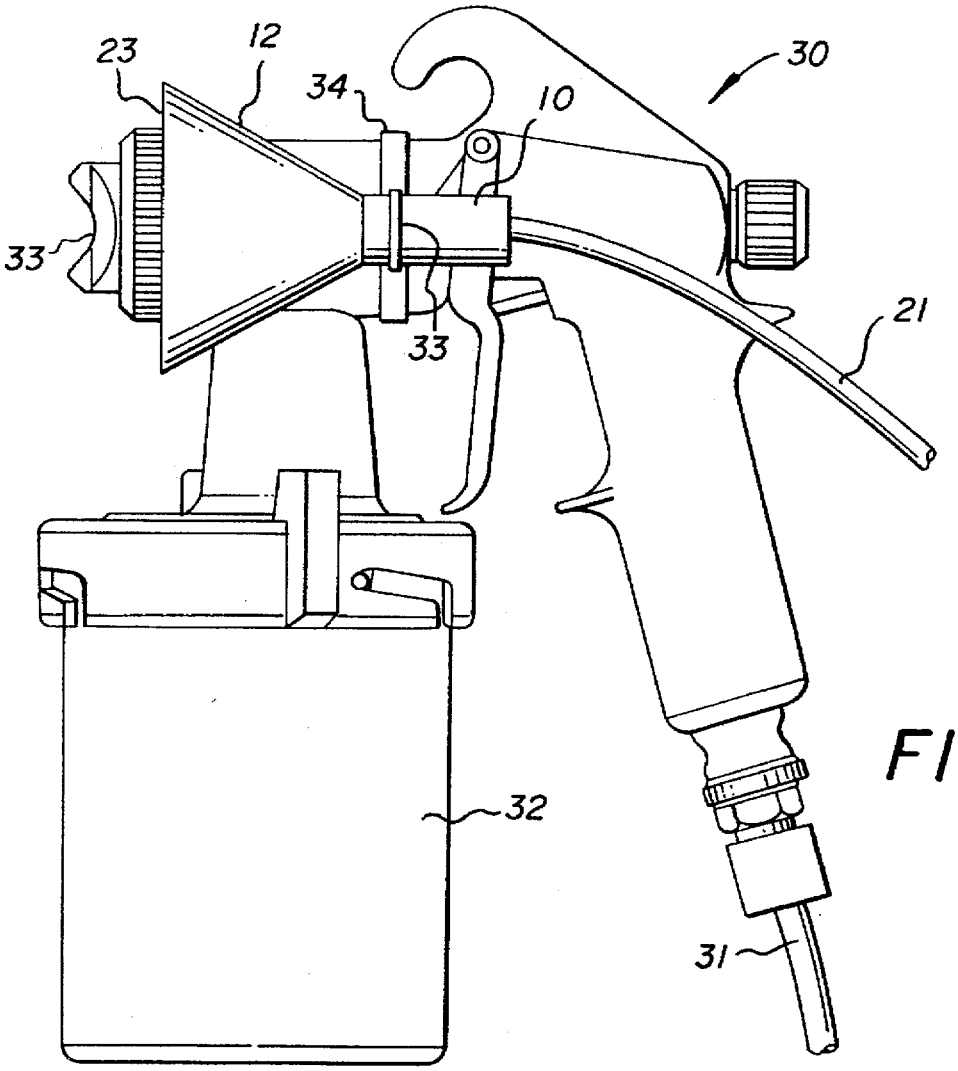
FIG. 4 is a side view of a spray gun with attached nozzle unit.

FIG. 4 is a side view of a spray gun with a nozzle unit attached. The spray gun 30 has an air hose 31 for provision of atomizing air and a reservoir 32 which holds the material to be sprayed, atomizable fluid or powder. The sprayed material is emitted by the nozzle 33. A nozzle unit 12 is attached to each side of the spray gun. The air curtain is emitted from the elongated nozzle 23 which is attached to the bore 10. HVLP air is provided to the bore through a hose or conduit 21. HVLP air passes from the conduit through the bore and is emitted by the elongated nozzle.

The nozzle unit 12 is attached to the spray gun by a barrel ring 34 which, in turn, is attached to a bore ring 39.

Figure 5:
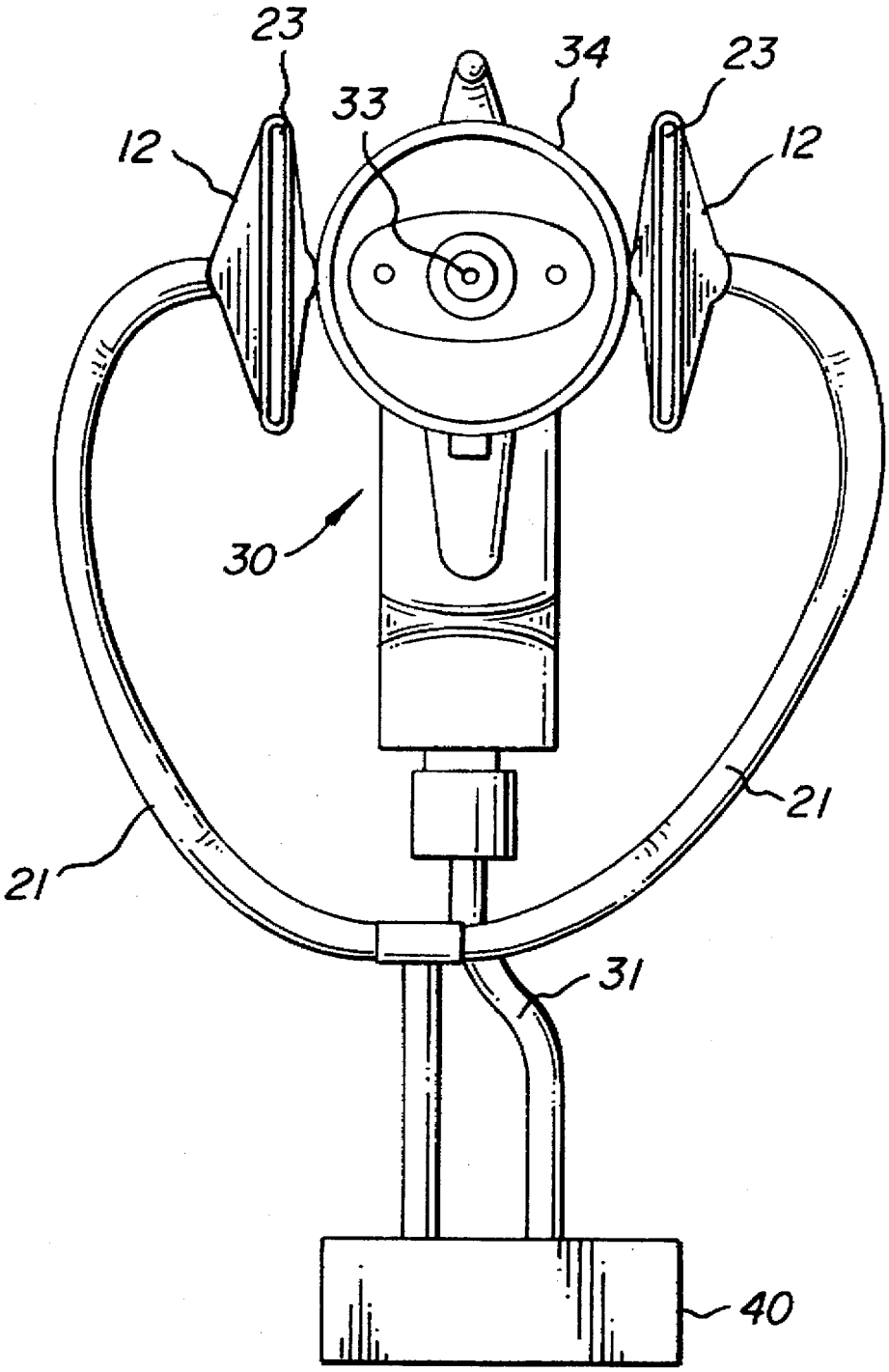
FIG. 5 is a front view of a spray gun with two attached nozzle units.

FIG. 5 is a front view of the spray gun 30 of FIG. 4. In this view, the reservoir 32 is omitted for clarity. The nozzle is at 32. The air hose 31 provides air to the spray gun. The air source 40 provides air to the spray gun 30 and also to the nozzle units 12 of the air chisels. The air source may provide the spray gun with HVLP air or with HPLV air. In this example, the HVLP air source also provides the air chisels with HVLP air. If the spray gun uses HPVL air, the air chisels may be provided with HVLP air from an air compressor, air turbine, or air blower. When the spray gun uses the airless method of spraying, no air source is necessary for the spray gun; the air chisels may be provided with HVLP air as above.

Also visible in FIG. 5 is the barrel ring 34 which attaches the nozzle units 12 to the spray gun 30, the elongated nozzles 23, and the hose or conduit 21 which provides LPHV air to the nozzle units.

Figure 6:
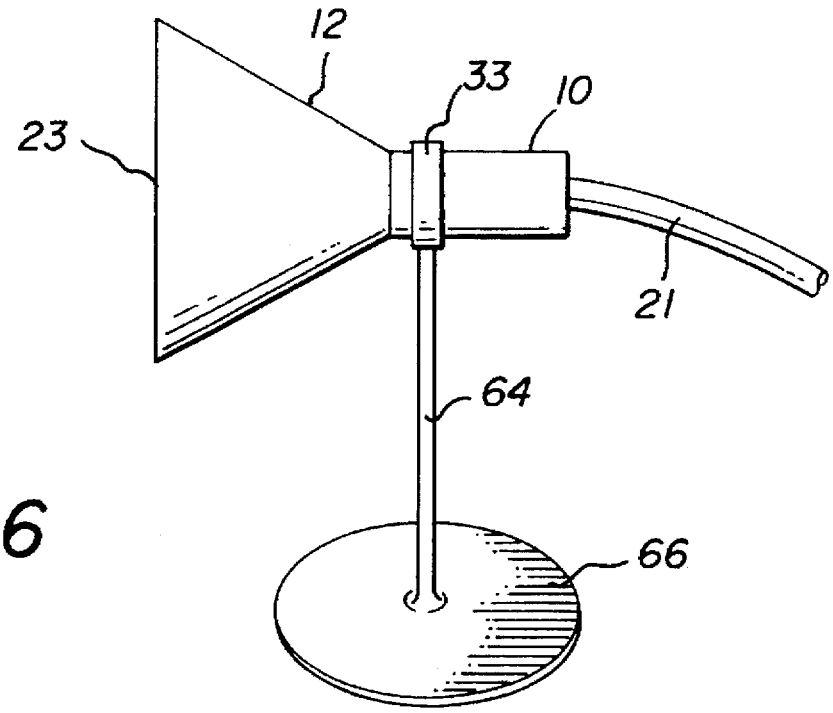
FIG. 6 is a side view of a nozzle unit attached to a stand.

FIG. 6 is a side view of a nozzle unit mounted on a stand. The nozzle unit 12 consisting of an elongated nozzle 23, a bore 10, and a hose 21, is connected by a bore ring 39 to the stand post 64, which is mounted on the stand base 66.

Figure 7:
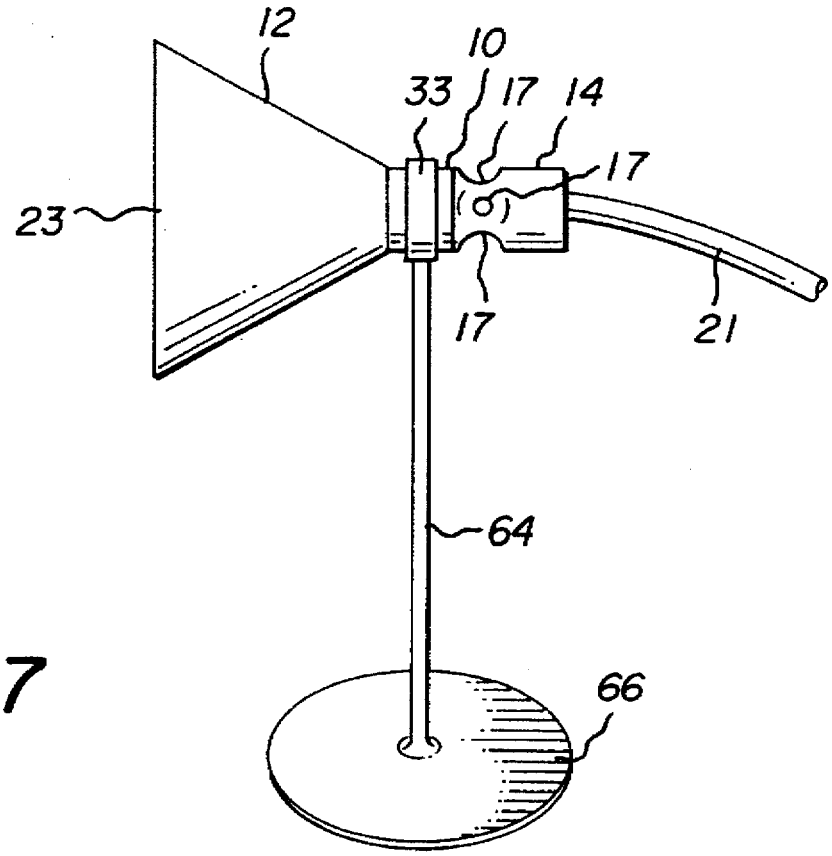
FIG. 7 is a side view of a nozzle unit having a jet induction pump attached to a stand.

FIG. 7 is a side view of a nozzle unit having a jet venturi pump mounted on a stand. The nozzle unit 12 consisting of an elongated nozzle 23, a bore 10, a jet venturi pump between the bore and the hose 14 which has three visible induction ports 17, and a hose 21, is connected by a bore ring 39 to the stand post 64, which is mounted on the stand base 66.

A nozzle unit having a jet venturi pump, as in FIG. 7, has the additional advantage of respraying any overspray which may reach the jet venturi induction pump. The overspray is induced into the induction ports 17 and resprayed from the elongated nozzle.

Figure 8:
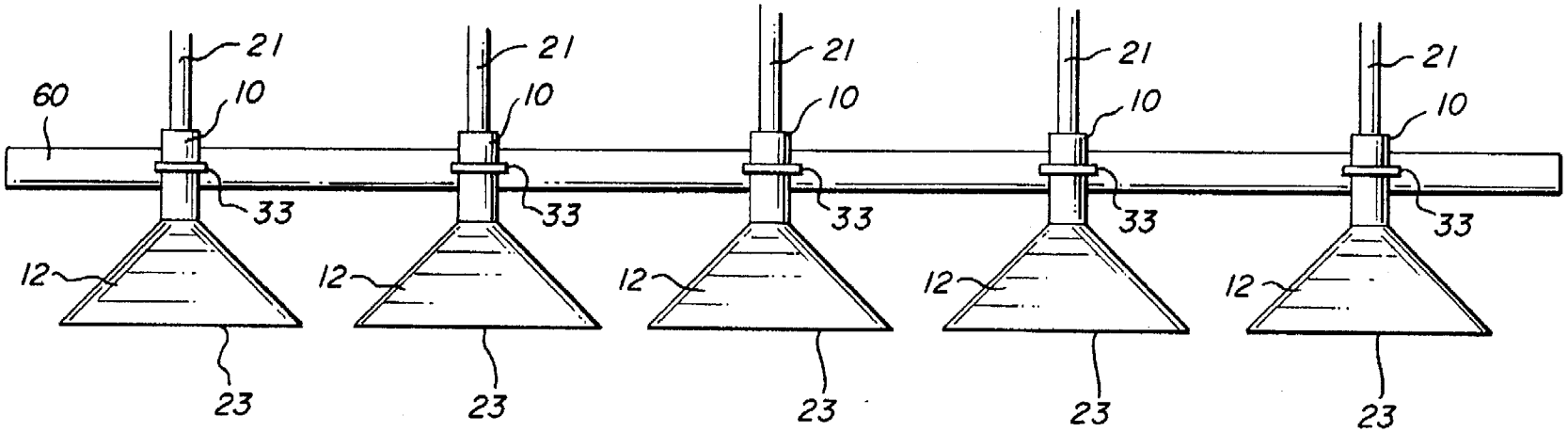
FIG. 8 is a side view of multiple nozzle units attached to a bar.

FIG. 8 is a top view of a mounting bar having four mounted nozzle units. The nozzle units 12 consisting of elongated nozzles 23, bores 10, and hoses 21 are mounted by bore rings on a mounting bar 60. Other means for attaching the nozzle units to a mounting bar may be used, such as nuts and bolts, screws, etc.

Figure 9:
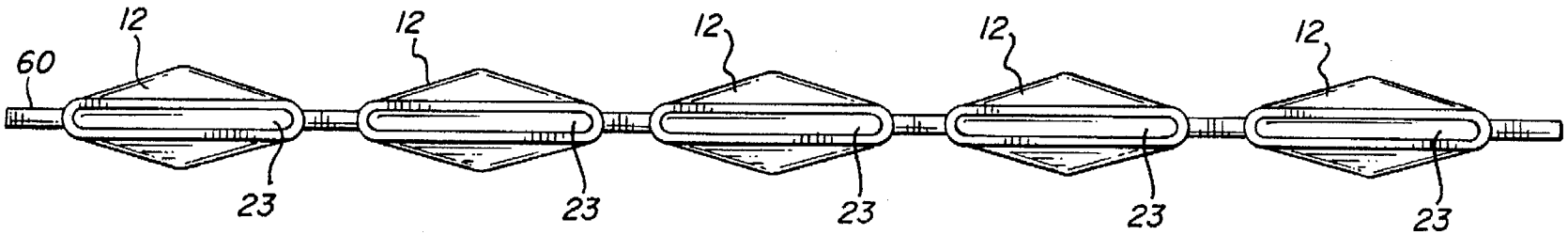
FIG. 9 is a front view of multiple nozzle units attached to a bar.

FIG. 9 is a front view of the mounting bar having four mounted nozzle units of FIG. 8. Visible are the mounting bar 60, nozzle units 12, and elongated nozzles 23.

Figure 10:
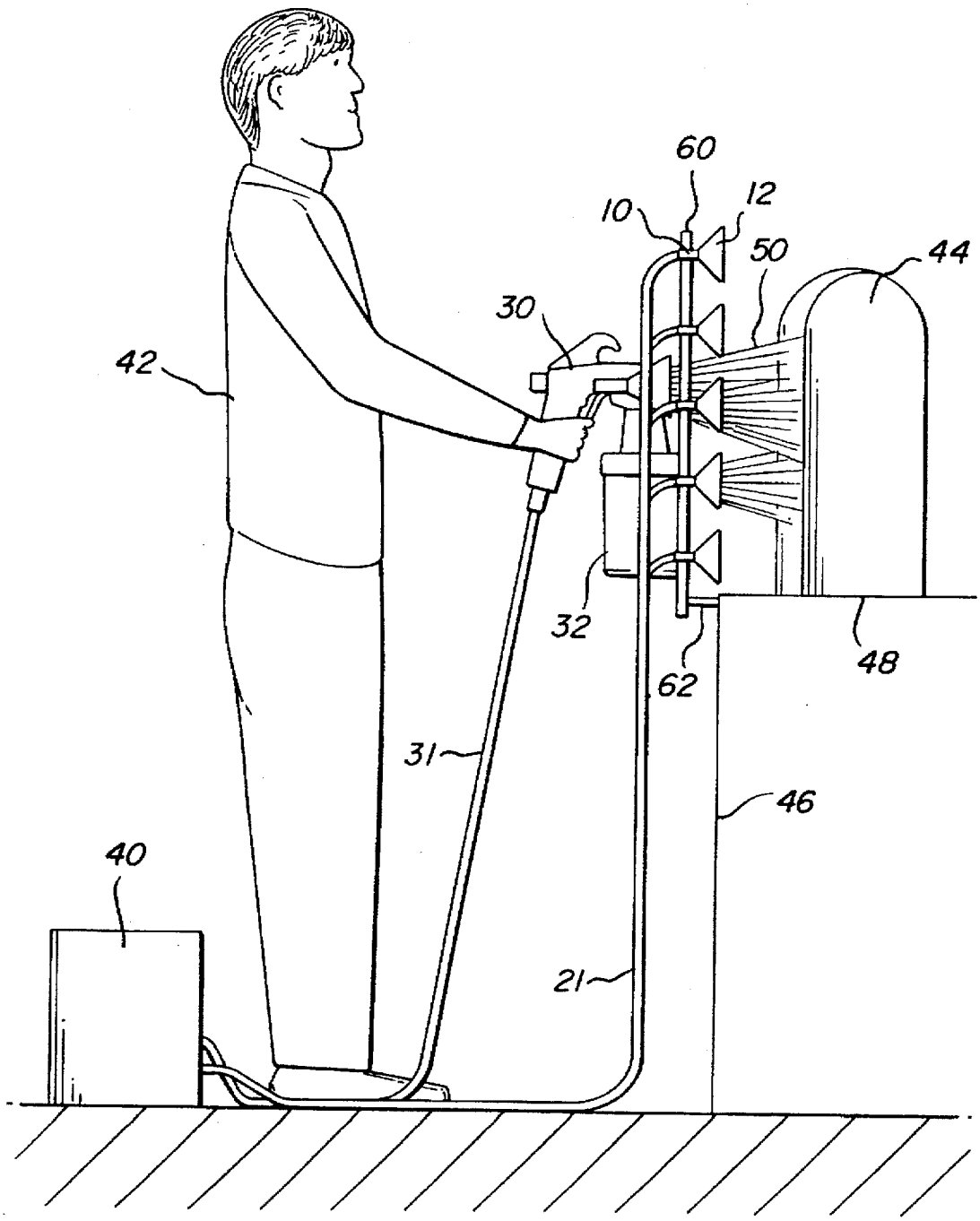
FIG. 10 is a side view of an operator spraying a work object in a spray booth with multiple nozzle units mounted on a bar and attached to the spray booth.

FIG. 10 is a side view of an operator 42 who is spraying a work object 44 using a spray gun 30 having a reservoir 32 and an air hose 31 which is connected to a compressor 40. The work object 44 rests on a horizontal support 48 in a spray area 46. Four nozzle units 12 mounted on a mounting bar 60 are mounted by a attachment bar 62 to the front of the spray area 46. The nozzle units are provided with HVLP air by a hose 21 from the air compressor 40. The nozzle units are mounted close enough to the work object to provide an oriented air curtain which contains and suppresses overspray, thus functioning as air chisels. A second similar group of four air chisels are not visible in FIG. 10 but are visible in FIG. 11.

Figure 11:
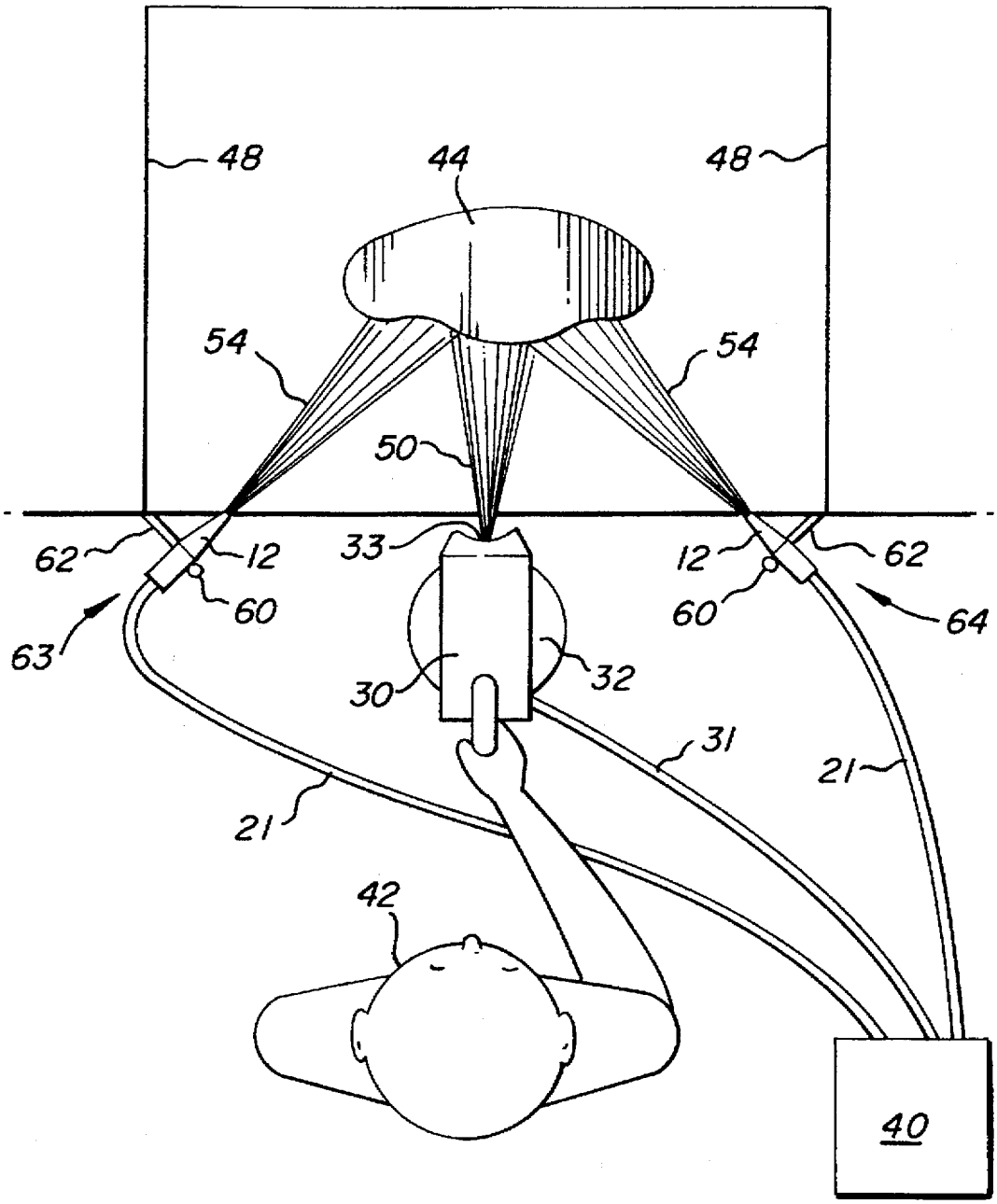
FIG. 11 is a top view of the operator spraying a work object of FIG. 9.

FIG. 11 is at top view of the scene of FIG. 10. both groups of mounted nozzle unit, the one on the left side 63 and on the right side 64 of the spray gun 30 are shown. Also shown in FIG. 11 is the sprayed material 50 emitted from the spray gun and the air curtains 54 emitted from the nozzle units.

Figure 12:
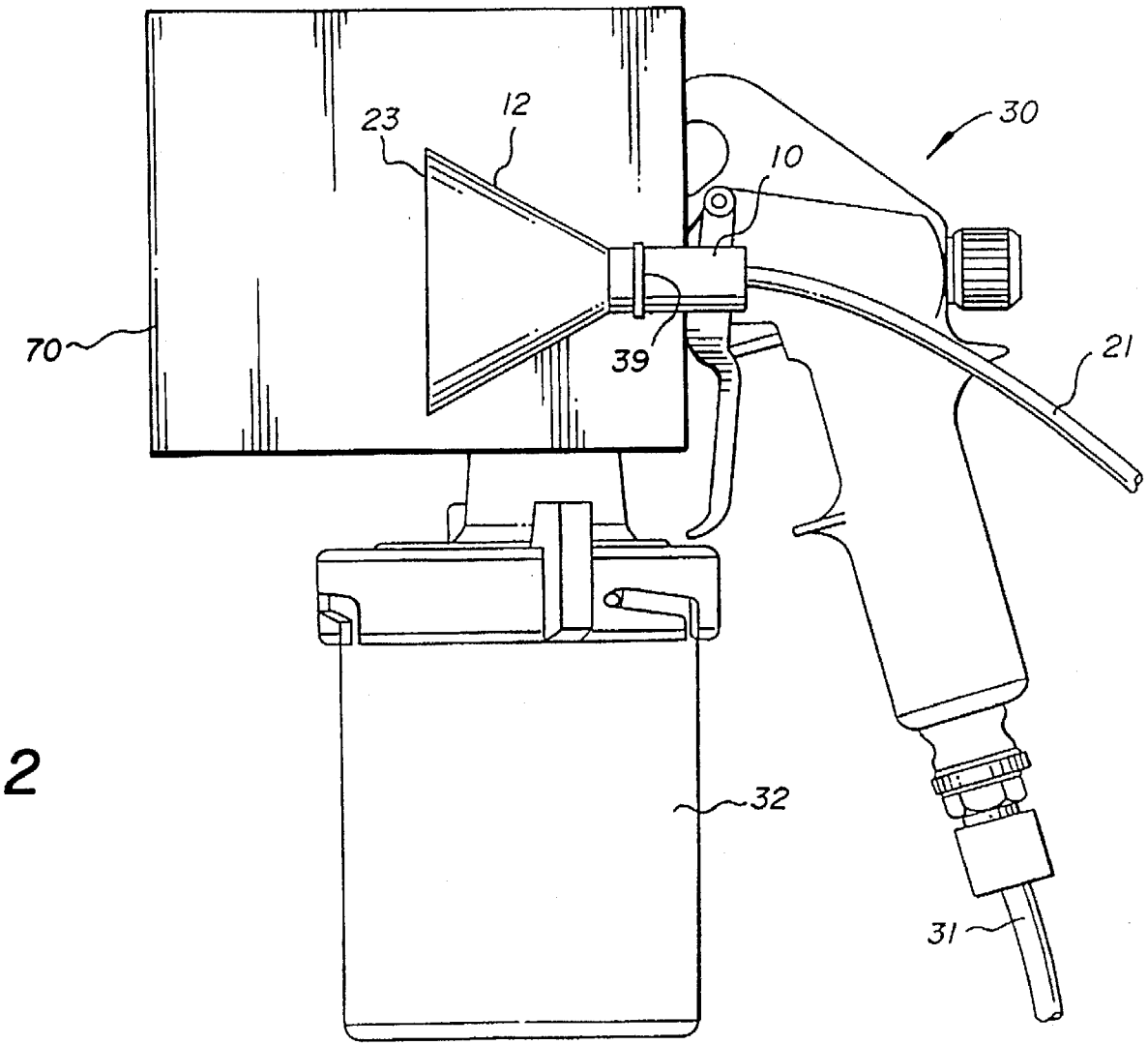
FIG. 12 is side view of a second embodiment spray gun with attached nozzle unit having a shield.
Figure 13:
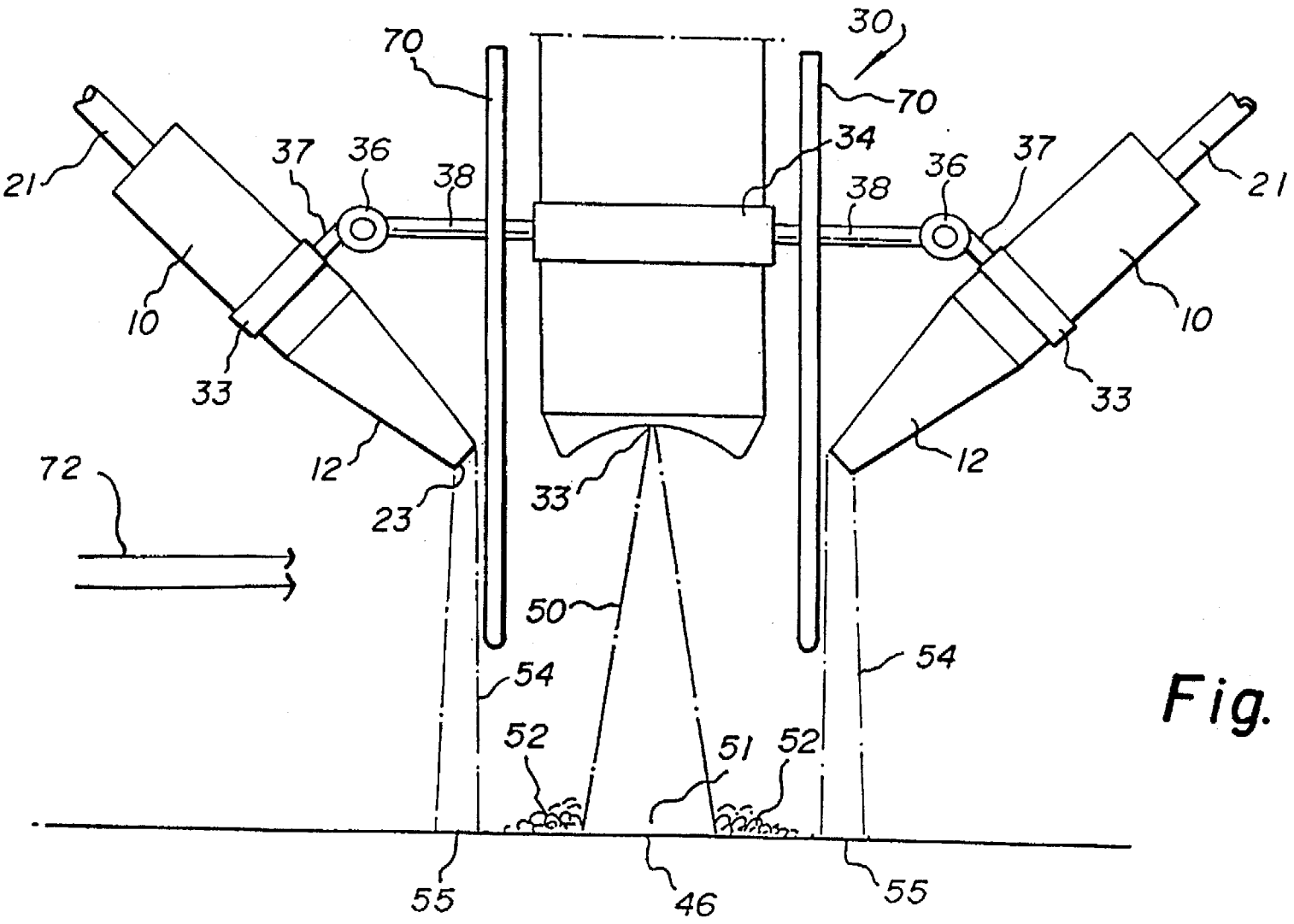
FIG. 13 is a diagram showing suppression of overspray by two air chisels in a second embodiment spray gun with attached nozzle unit having a shield.

FIG. 12 is a side view of a second embodiment of a spray gun with a nozzle unit attached. In this embodiment a shield 70 is interposed between the nozzle unit 12 and the spray gun 30. The orientation of the shield is approximately parallel to the air curtain. The other elements of the second embodiment spray gun of FIG. 13 are as in FIG. 4. The function of the shield 70 is to direct the flow of HVLP air emitted from the nozzle unit 12 and aid in the repression of bounceback.

FIG. 13 is a diagram showing suppression of bounce back by air chisels in a second embodiment spray gun having shields 70 and 72 between the spray plum 50 and the oriented air curtains 54. The shields 70 and 72 are mounted on the spray gun posts 38. The other elements of the second embodiment spray gun of FIG. 12 are as in FIG. 1. The air curtains 54 are deflected by shields 70 and 72 and directed toward the work surface 46 where they suppress overspray 52. Shields 70 and 72 also act to prevent disruption of air curtains 54 or of spray of atomizable liquid or powder 50 by any air currents 72 which are approximately parallel to the work surface 46. Such air currents 72 are redirected by shield 70 and incorporated into air curtain 54.

It will be apparent to those skilled in the art that the examples and embodiments described herein are by way of illustration and not of limitation, and that other examples may be used without departing from the spirit and scope of the present invention, as set forth in the appended claims.

I claim:

1. Air chisel apparatus for containing overspray associated with the spraying of liquids and powders from a spray gun onto a work surface comprising:

an air chisel, said air chisel comprising:

a nozzle unit laterally disposed at the side of said spray gun, said nozzle unit comprising an elongated nozzle for providing an air curtain of high volume low pressure air at said work surface, conduit means for providing said elongated nozzle with high volume low pressure air, a bore connecting said elongated nozzle and said conduit means, and wherein an air curtain consisting of high volume low pressure air is directed from said nozzle unit toward said work surface at an angle from 10° to 80° to a line perpendicular to said work surface, with said air curtain directed toward the point of impact of said spray with said work surface, and source means for providing said air chisel with high volume low pressure air, said air chisel having sufficient flow to blow said overspray against said work surface, thereby reducing the escape of said overspray into the atmosphere and producing a smoother finish on said work surface, and support means for supporting said air chisel in proximity to said work surface.

2. The apparatus of claim 1 wherein support means for said air chisel is a mount connecting said chisel unit to said spray gun.

3. The apparatus of claim 1 wherein said support means for said air chisel is a stand.

4. The apparatus of claim 1 wherein said high volume low pressure air source means for providing said air chisel with high volume low pressure air is an air turbine.

5. The apparatus of claim 1 further comprising a jet induction pump between said bore and said conduit means for providing said elongated nozzle with high volume low pressure air.

6. Air chisel apparatus for containing overspray associated with the spraying of liquids and powders from a spray gun onto a work surface comprising:

two air chisels, each air chisel attached on opposite sides of said spray gun, each air chisel comprising:

a nozzle unit, said nozzle unit comprising an elongated nozzle, a bore connected to said elongated nozzle for providing high volume low pressure air to said elongated nozzle, and a hose connected to said bore for providing said bore with high volume low pressure air, wherein an air curtain is directed from said nozzle unit toward said work surface at an angle from 10° to 80° to a line perpendicular to said work surface, said air curtain directed toward the point of impact of said spray with said work surface, said air chisels having sufficient flow to blow said overspray against said work surface, thereby reducing the escape of said overspray into the atmosphere and producing a smoother finish on said work surface.

7. Air chisel apparatus for containing overspray associated with the spraying of liquids and powders from a spray gun onto a work surface comprising:

an air chisel, each air chisel comprising:

a nozzle unit laterally disposed at the side of said spray gun, said nozzle unit comprising an elongated nozzle for providing an air curtain of high volume low pressure air at said work surface, conduit means for providing said elongated nozzle with high volume low pressure air, a bore connecting said elongated nozzle and said conduit means, and wherein an air curtain consisting of high volume low pressure air is directed from said nozzle unit toward said work surface at an angle from 10° to 80° to a line perpendicular to said work surface, with said air curtain directed toward the point of impact of said spray with said work surface, and source means for providing said air chisel with high volume low pressure air, and support means for supporting said air chisel in proximity to said work surface, and a shield mounted between the spray gun and nozzle unit, said shield oriented approximately parallel to said spray of atomizable liquid or powder coating.

8. The apparatus of claim 7 wherein said shield deflects an air current approximately parallel to said work surface and prevents disruption of said spray of atomizable liquid or powder coating or of said air curtain by said air current.

9. The apparatus of claim 7 wherein said shield deflects an air current approximately parallel to said work surface and incorporates said air current into said air curtain.

10. The apparatus of claim 7 wherein the flow of said high volume low pressure air is directed by a shield interposed between said nozzle unit and said spray gun.

11. Air chisel apparatus for containing overspray associated with the spraying of liquids and powders from a spray gun onto a work surface comprising:

an air chisel, said air chisel comprising:

a nozzle unit laterally disposed at the side of said spray gun, said nozzle unit comprising an elongated nozzle for providing an air curtain of high volume low pressure air at said work surface, conduit means for providing said elongated nozzle with high volume low pressure air, a bore connecting said elongated nozzle and said conduit means, and wherein an air curtain consisting of high volume low pressure air is directed toward said work surface from said nozzle unit at an angle from 10° to 80° to a line perpendicular to said work surface, with said air curtain directed toward the point of impact of said spray with said work surface, and source means for providing said air chisel with high volume low pressure air, and support means for supporting said air chisel in proximity to said work surface, wherein said high volume low pressure air source means for providing said air chisel with high volume low pressure air is an air compressor.

12. Air chisel apparatus for containing overspray associated with the spraying of liquids and powders from a spray gun onto a work surface comprising:

an air chisel, said air chisel comprising:

a nozzle unit laterally disposed at the side of said spray gun, said nozzle unit comprising an elongated nozzle for providing an air curtain of high volume low pressure air at said work surface, conduit means for providing said elongated nozzle with high volume low pressure air, a bore connecting said elongated nozzle and said conduit means, and wherein an air curtain consisting of high volume low pressure air is directed toward said work surface from said nozzle unit at an angle from 10° to 80° to a line perpendicular to said work surface, with said air curtain directed toward the point of impact of said spray with said work surface, and source means for providing said air chisel with high volume low pressure air, support means for supporting said air chisel in proximity to said work surface, and said support means having a multiplicity of air chisels placed thereon.

13. The apparatus of claim 12 wherein said air chisels are attached to a bar.

14. The apparatus of claim 12 wherein said support means for said air chisels is a mount connecting said air chisels to said spray gun.

15. The apparatus of claim 12 wherein said support means for said air chisels is a stand.

16. Air chisel apparatus for containing overspray associated with the spraying of liquids and powders from a spray gun onto a work surface comprising:

two air chisels, each air chisel comprising:

a nozzle unit attached to one side of said spray gun, said nozzle unit comprising an elongated nozzle, a bore connected to said elongated nozzle for the provision of high volume low pressure air to said elongated nozzle, a hose connected to said bore for providing said bore with high volume low pressure air, wherein an air curtain is directed toward said work surface from said nozzle unit at an angle from 10° to 80° to a line perpendicular to said work surface, said air curtain directed toward the point of impact of said spray with said work surface and each air chisel further comprises one shield said, shield mounted to said nozzle ring between said nozzle ring and said nozzle unit, each shield oriented approximately parallel to said spray of said atomizable liquid or powder.

17. The apparatus of claim 16 wherein said air curtain is oriented by said shield.

18. The apparatus of claim 16 wherein said shield deflects an air current approximately parallel to said work surface and prevents disruption of said spray of atomizable liquid or powder coating or of said air curtain by said air current.

19. The apparatus of claim 16 wherein said shield deflects an air current approximately parallel to said work surface and incorporates said air current into said air curtains.

20. The apparatus of claim 16 further comprising a jet induction pump between said bore and said hose for providing high volume low pressure air to said elongated nozzle.

* * * * *